US005947508A

United States Patent [19]

Graf et al.

[11] Patent Number: 5,947,508

[45] Date of Patent: Sep. 7, 1999

[54] BINDING FOR A SPORTS APPARATUS

[75] Inventors: Josef Graf, Frasdorf, Germany; Daniel Vuichard, Bern, Switzerland

[73] Assignee: SSG (Europe) SA, Givisiez, Switzerland

[21] Appl. No.: 08/875,102

[22] PCT Filed: Jan. 22, 1996

[86] PCT No.: PCT/CH96/00030

§ 371 Date: Oct. 6, 1997

§ 102(e) Date: Oct. 6, 1997

[87] PCT Pub. No.: WO96/22136

PCT Pub. Date: Jul. 25, 1996

[30] Foreign Application Priority Data

Jan. 20, 1995 [DE] Germany ..... 295 00 862 U

[51] Int. Cl.[6] ..... A63C 9/00

[52] U.S. Cl. ..... 280/616; 280/613; 280/617

[58] Field of Search ..... 280/607, 613, 280/616, 617, 618, 624, 625

[56] References Cited

U.S. PATENT DOCUMENTS 4,027,896 6/1977 Frechin et al. ..... 280/618
4,166,635 9/1979 Salomon ..... 280/618
4,479,664 10/1984 Gertsch ..... 280/625
5,207,445 5/1993 Hoelzl ..... 280/607
5,236,216 8/1993 Ratzek ..... 280/607

*Primary Examiner*—Robert J. Oberleitner
*Assistant Examiner*—Robert J. McCarry, Jr.
*Attorney, Agent, or Firm*—Oblon, Spivak, McClelland, Maier & Neustadt, P.C.

[57] ABSTRACT

The binding for a sports apparatus, particularly for a snowboard, ski, monoski, or snowshoe, with rotary closure, has a hub (34) fixed to the sports apparatus, about which hub a binding support plate (19) is rotatingly disposed. The binding support plate (19) is fixable in relation to a hub in the running position, and two binding bodies having holding means for a boot are secured thereto. Connected to the hub fixed to the sports apparatus is at least one element (36) receiving pulling and/or pushing forces, one end of which engages the hub (34, 35), and the other end of which is coupled to a holding device. Upon rotation of the binding support plate (19), the holding device fixes a boot in the binding or releases it as a function of the position relative to the hub through co-operation with the element (36) receiving pulling and/or pushing forces.

34 Claims, 3 Drawing Sheets

BINDING FOR A SPORTS APPARATUS

BACKGROUND OF THE INVENTION

1. Field of the Invention

2. Technical Field

The invention relates to a binding for a sports apparatus, particularly for a snowboard, ski, monoski, or snowshoe, which binding allows a facilitated entry through a rotary movement of the boot.

DESCRIPTION OF THE BACKGROUND

Bindings are known in which the user, for fixing the ski boot in the binding, need only get into the latter (German Utility Model 94 06 441, EP-A672 438). It is not necessary, in so doing, for the user to bend down. It is not out of the question, however, for a misfunction to occur, i.e., the user gets into the binding without the desired fixing of the boot in the binding coming about. In such cases, it is true that the boot can be lifted out, but it is essential, for getting in anew, to return the binding to the starting position, for which purpose it is necessary, however, for the user to bend down.

SUMMARY OF THE INVENTION

The problem underlying the invention is to form a binding for a sports apparatus in such a way that even after a mis-entry, it is not necessary for the binding to be returned to the entry position by the user's hand.

The solution of this problem takes place through the features indicated in claim 1, the distance between the binding bodies or of holding jaws being modified by a partial rotation of the user's boot, the binding closing on the boot or opening through lessening or increasing of the distance. This modification of distance is brought about only by the boot.

In a preferred embodiment, a modification of the distance between the binding bodies is caused by rotation of the boot in relation to the sports apparatus, namely, in one direction of rotation in the sense of a shortening of the distance, and in the other direction of rotation in the sense of an increase of the distance. Through the shortening of the distance, the binding is brought into closure position.

After a mis-entry, it is not necessary for the user to bend down.

Advantageous further designs of the binding according to claim 1 are defined in the dependent claims.

The invention is explained in more detail below by means of the exemplary embodiments shown in the drawings.

DETAILED DESCRIPTION OF THE INVENTION

Figure 1:
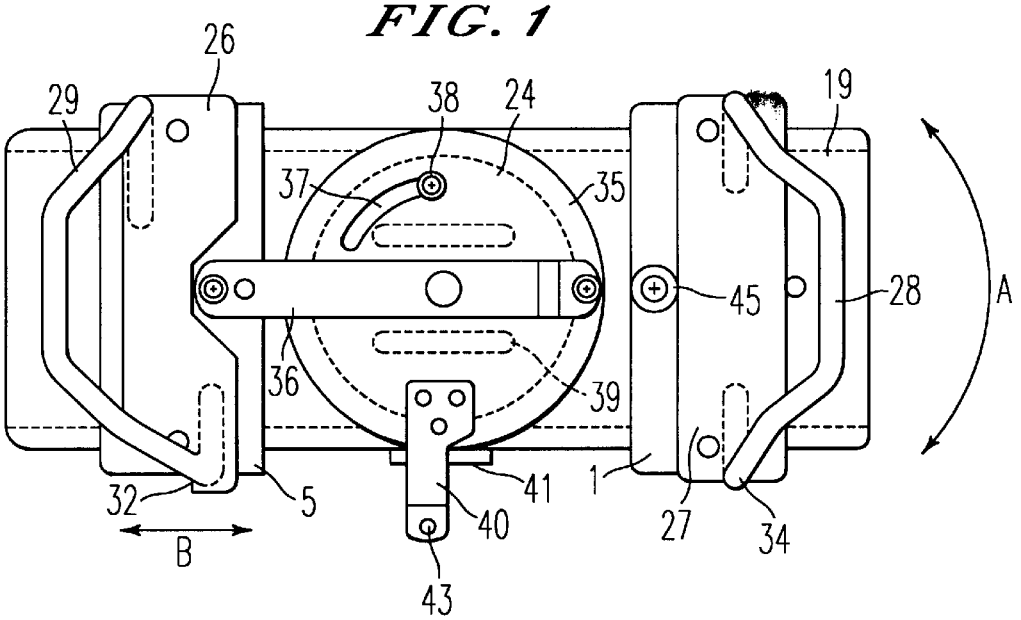
FIG. 1 shows a top plan view of a first embodiment of the present invention.
Figure 2:
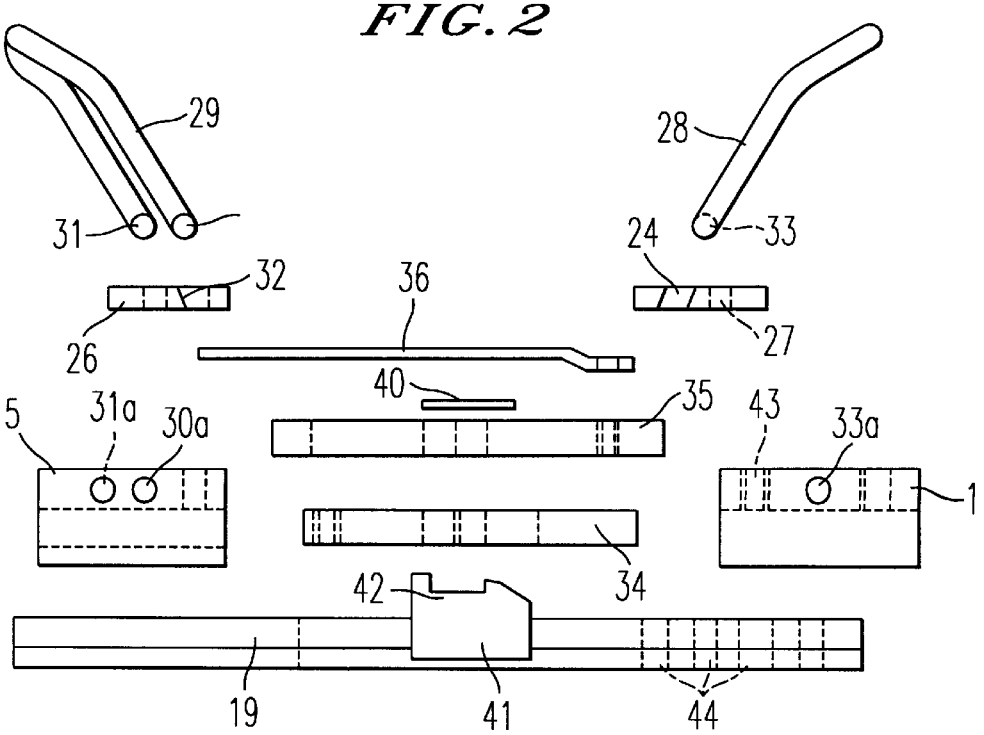
FIG. 2 shows a side elevation of the subject of FIG. 1 in an exploded view.

In the exemplary embodiment for a snowboard binding according to FIGS. 1 and 2, a binding plate 19 twistable about a freestanding hub consisting of a disk 34 and cover 35A, is provided. The consists of a disk 34 is fixed to the snowboard, the longitudinal position of which disk is determined by screws engaging slots 39, and of a cover 35 fastened on the disk 34. For adjusting the desired oblique running position, the cover 35 can swivel in relation to the disk 34 in an angular sector in that a screw 38 engages a curved slot 37, through tightening of which screw the cover 35 is pressed against the disk 34 and thereby set in the desired angular position.

Disposed on the binding support plate 19 are binding bodies 1 and 5. The binding part shown in FIG. 1 co-operates with the binding support plate 19 according to FIG. 2 in such a way that the binding bodies 1 and 5 are pushed in positive mechanical engagement onto the binding support plate 19.

The binding support plate 19 is rotatingly connected to the snowboard by the hub parts 34 and 35.

The binding body 1 is fixed in relation to the binding support plate 19, which takes place by means of a screw 45 which fits in a screw hole 43 in the binding body 1, and the tip of which screw engages one of several holes 44 in the binding support plate 19.

The binding body 5 is displaceable in relation to the binding support plate 19 and bears a stop yoke 29. This yoke or jaw is brought into an upright position in that its end legs 30 and 31 fit in staggered bores 30*a* and 31*a*, respectively. The end position of the stop yoke 29 is determined in that the stop yoke 29 rests against stop faces 32 which are formed in a bearing plate 26 secured on the binding body 5.

The stop yoke or jaw 28 is disposed on the binding body 1 in a similar manner. Here, too, stop faces 84 are disposed in a bearing plate 27.

The sliding binding body 5 is connected to the cover 35 fixed in relation to the snowboard by an element 36 in the form of a traction and pressing rod. The end of the element 36 opposite the fastening location on the binding body 5 is mounted eccentrically on the cover 35. Upon twisting of the binding support plate 19 in relation to the stationary hub consisting of the disk 34 and cover 35 in the direction of the arrow A, the binding body 5 is moved in the direction of the arrow B because of the eccentricity of the articulation of the element 36, whereby the distance between the binding bodies 1 and 5 is modified.

In FIG. 1, the position of the binding is shown in which there is a minimum distance between the binding bodies 1 and 5. It is not necessary for the element in this position to be aligned in the longitudinal direction of the binding, the minimum distance can rather be produced even with an obliquely running element 36.

Serving to fix the binding in the running position is the stop lever 40, pressed resiliently downward, which engages a notched number 42 of a stop member 41 fastened laterally to the binding support plate 19. At the end of the stop lever 40 there is an eye 43 in which a handle (e.g., a safety strap) causing the lifting of the stop lever 40 may be fastened.

Figure 3:
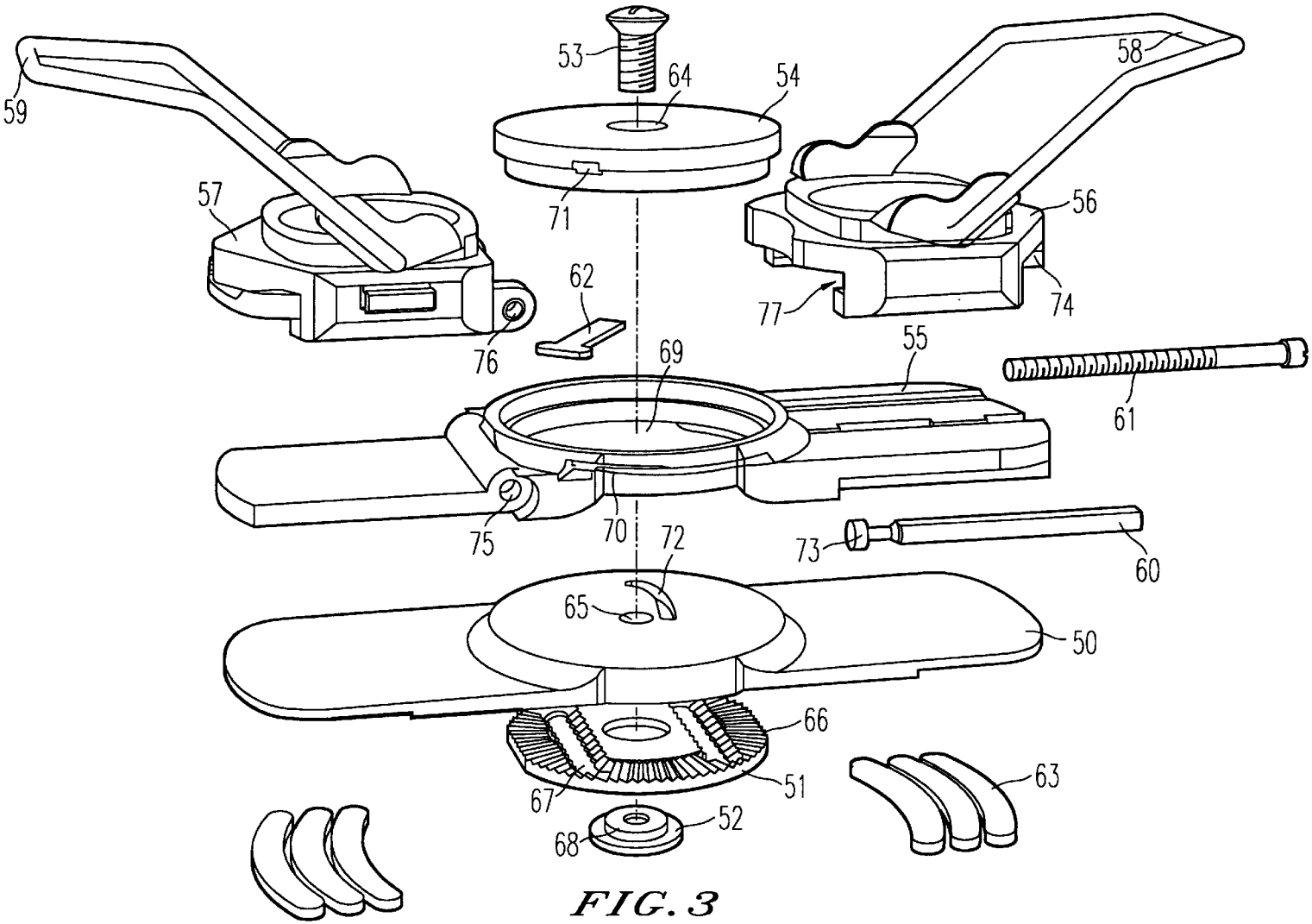
FIG. 3 shows an exploded drawing of a second embodiment of a binding according to the present invention.

FIG. 3 shows a further arrangement of the present invention. The binding depicted, which is especially useful for snowboards, is secured to the board by screws through the slots 67 of the base plate 51. Disposed beneath the central bore 66 is a screwed nut 52, secured against rotation by a tooth construction, with the bore 68 having an internal thread. Over the base plate, which has a tooth construction, the hub plate 50, secured by the toothing 66, is put on. The hub plate 50 rests upon the sports apparatus in front of and behind the base plate. For improving the comfort, for damping vibrations,and for stabilizing the binding, damping elements 63 of an elastomer are provided under the plate 50, in front of and behind the base plate 51, which damping elements may be may be inserted or stuck into a corresponding groove (not is shown) in the plate 50. Here in turn there is a central bore 65 which is used for fastening. Above is the binding support plate 55 which is rotatingly screwed to the fastening plate 51 by means of the cover 54 and the screw 53.

Disposed on the binding support plate 55 with the opening 69 intended for the cover 54 are the front binding body 56 and rear binding body 57 which are intended to hold a boot by means of the round-steel yokes or jaws 58, 59. The front binding body has on both sides inwardly directed guide grooves 77 which are intended to grasp the guide surfaces 78 in positive mechanical engagement. The binding body 56 is thereby displaceable longitudinally relative to the binding support plate. The rear binding body 57 may have a similar arrangement. In the present embodiment, this body can swivel about a spindle (not shown) inserted in the bores 75, 76. The holding plate embodied by the binding body 57 for the heel of the boot can thereby be raised by an adjusting mechanism.

The cover 54, which represents part of the rotation hub for the binding support plate 55, has a securing opening 71 for a permanent securing of the stop member 62. The stop member 62 is intended to engage the guide slot 70 of the binding support plate. Through the stop member, the angle of rotation of the binding support plate is restricted to the desired range and, by means of a notch within the guide slot 70, allows locking in the running position. In the present embodiment, the front binding body 56 is subjected to a longitudinal displacement during the rotary movement by the element 60 receiving the pulling and/or pushing forces and the setscrew 61. The gripping means 73 of the element 60 receiving pulling and/or pushing forces constantly engages the guide groove 72 of the hub body. Since the guide groove 72 has a guide surface, a longitudinal movement is forced upon the element 60 in that pressure or traction is exerted upon the gripping means 73, which movement is responsible for the closure function of the binding.

The stop means 62 of the binding presented above may, as in the embodiment according to FIG. 1, be provided with an eye which serves for fastening of a safety strap. With such an arrangement, the binding can be opened easily and conveniently by a pull on the safety strap.

The hub and the binding support plate may be connected by a coil spring so that upon rotation of the binding support plate from the "open" position to the "closed" position, a resistance is to be overcome. The binding thereby rotates back again into its starting position through the spring tension upon opening.

The mode of operation of the bindings shown in FIGS. 1 to 3 is as follows:

When the user gets out of the binding, the binding bodies 1 and 5 have a spacing which makes getting out possible. The binding remains in this position for a new entry. Upon getting in, the stop yoke 29 is pressed away with elastic deformation and, after the boot is placed on the bearing plate 26, swivels back into its upright starting position. By rotating the boot together with the binding, which takes place with the side surfaces of the boot resting against the legs of the stop yokes 28 and 29, the binding body 5 is moved under the influence of the element 36 of the binding body 5 toward the binding body 1. This rotation of the boot with the binding takes place until the stop yokes 28 and 29 engage the corresponding notches on the boot and the boot is thereby fixed in the binding.

In case of a mis-entry, the binding is rotated back again by the boot or by the force of a possibly present spring, and the entry into the opened binding is attempted anew. The locking of the binding in the running position does not take place until an orderly entry into the binding has taken place.

Figure 5:
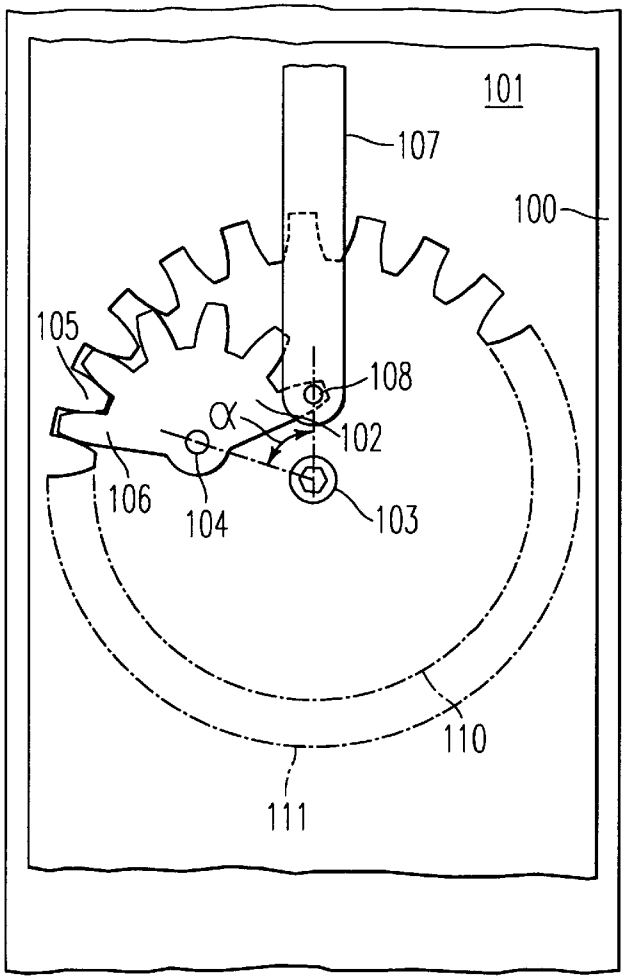
FIG. 5 shows the mechanism according to FIG. 4 in a second position.
Figure 4:
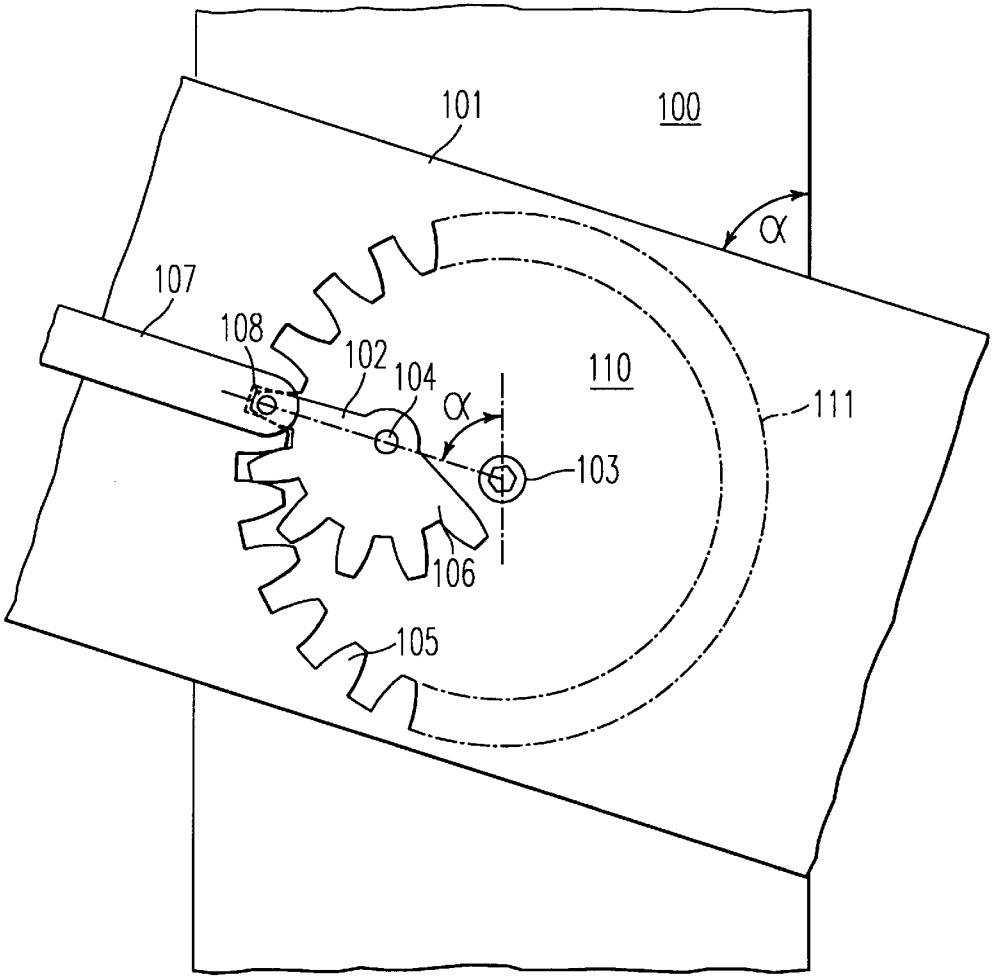
FIG. 4 shows a mechanism for a binding according to the invention, in which a rotary movement is converted into a stroke movement, in a first position.

FIGS. 4 and 5 show a mechanism by which a rotary movement of the binding support plate 101 relative to a base plate 100, representing a hub body, mounted permanently on a sports apparatus, causes a longitudinal movement of an element 107 receiving pulling and/or pushing forces in longitudinal direction with respect to the support plate 101. In FIG. 4 the binding support plate 101 is at an angle alpha relative to the base plate. The plate 101 has a central circular opening 110, in the middle of which is the pivot point of the binding support plate embodied by a screw 103. Within the opening 110, the view of the base plate 100 is free. At the periphery of this opening 110 are teeth 105. Disposed on the base plate 100 is a toothed-wheel segment 102, the radius of which amounts to half of the radius of the opening 110. The pivot of the toothed-wheel segment 102, the teeth 106 of which mesh with the teeth 105 of the support plate 101, is in the middle of the radius of the opening 110 on the hub body 100. The element 107 receiving pulling and/or pushing forces is secured to a crank 108 situated at the periphery of the toothed-wheel segment. In the open position of the binding, the crank 108 is as close as possible to the pitch diameter. This is the position by which the pivot 104 of the toothed-wheel segment 102 is determined. It is situated in the middle of the radius of the opening 110, which is determined by the element 107 in open position (angle of the binding support plate=alpha), in which the pivots 103 and 108 are on a straight line parallel to the support plate, corresponding to the alignment of the element 107.

Now, if the binding support plate 101 according to the representation in FIG. 1 is moved clockwise, the toothed segment 102 is moved by the toothing 105, the crank 108 moving toward the center 103 of the opening 110. When the size ratio of the radius of the toothed segment 102 to that of the opening 110 is 1:2, then upon a movement the crank 108 moves in a straight line relative to the binding support plate 101. Upon a further rotation of the binding support plate 101, the position is reached as is shown in FIG. 5. Here the binding support plate 101 and the base plate 100 are in a parallel position. In this position, the crank 108, to which the element 107 is fastened, has a position beside the pivot 103 of the opening 110. In this position, a binding body (not shown), which is connected to the element 107, is in a position displaced toward the pivot 103. This position embodies the fixing position since here the two binding bodies have the smallest spacing in the present configuration. The mechanism described allows a reliable transmission of the rotary movement into a longitudinal movement by which the boot can be fixed or released. The mechanism operates according to the principle of the Cardan gear crank. It can be utilized in the embodiment shown in FIG. 3. In the embodiment disclosed in FIGS. 4 and 5, too, the axis of rotation of the binding support plate is determined by a cover corresponding to the cover 54 in FIG. 3. This cover is fastened to the pivot 103 by means of a screw, the guidance taking place by the edge 111. For locking, a stop element analogous to that in FIG. 3 may likewise be utilized.

In the foregoing, bindings have been described in which there is only one sliding binding body 5 and hence only this binding body, too, is connected to the hub 34, 35 via the element 36. It is also possible, however, for both binding bodies 1 and 5 to be displaceable in relation to the binding support plate 19 and for each of the two binding bodies to be impacted by its own element acting eccentrically on the hub.

In the exemplary embodiments, a pressing and traction rod is used as element 36. It is also possible, however, to use a pure traction member, e.g., in the form of a rope, for reducing the distance between the binding bodies, which rope must naturally likewise be affixed eccentrically to the hub. In this case, however, it is necessary that mechanical means of their own, e.g., springs, be used for increasing the spacing of the binding bodies.

In the exemplary embodiments described in FIGS. 1 to 3, fixing of the boot takes place in that the binding bodies are pushed toward each other and the stop yokes thereby engage the shoe. Alternatively, however, the element 36 may likewise act upon clamping jaws or other boot-fastening means in such a way that the boots are fixed in the desired position on the snowboard. Specially adapted softboots could then also be used as boots, or else the clamping jaws could fix an adapter part for receiving softboots on the binding.

The binding according to the invention may be used for all types of sports apparatus in which boots must be fastened thereto. Thus, use of the binding for roller skates may also be envisaged, where the roller part can easily be removed and remounted.

We claim:

1. A binding for one of a snowboard, ski, monoski, and a snowshoe, which comprises:

a hub;

a binding support plate rotatingly disposed about said hub, the binding support plate being fixable in relation to the hub in the running position and bearing two bodies having holding means secured thereto for a boot; and at least one element receiving pulling and/or pushing forces, said at least one element being connected to the hub, a first end of said at least one element engaging the hub and a second end thereof being coupled to said holding means such that upon rotation of the binding support plate, the holding means fixes the boot in the binding or releases the boot by the mutual spacing of the binding bodies being modified as a function of the position thereof relative to the hub through an operative connection via said at least one element being connected to the hub, one end thereof being formed so as to engage the hub in cooperation with said at least element.

2. Binding according to claim 1, wherein the holding means comprises one pair each of sliding or swiveling holding jaws which are respectively secured to the two bodies.

3. Binding according to claim 1, wherein the holding means comprises a pair of swiveling stop yokes which are respectively secured to the two bodies.

4. Binding according to claim 3, wherein said at least one element is mounted eccentrically on the hub.

5. Binding according to claim 3, wherein said at least one element has an engaging means, and a guide groove is formed in the hub, the engaging means engaging the guide groove in such a way that upon rotation of the binding support plate, said at least one element pulling and/or pushing forces undergoes longitudinal movement relative to the rotary binding support plate, which movement is transmitted to the body connected thereto.

6. Binding according to claim 3, wherein bearing plates are disposed on the binding bodies, said bearing plates having stop faces for limiting swivel movement of the stop yokes.

7. Binding according to claim 1, wherein at least one of said bodies is displaceable on the binding support plate.

8. Binding according to claim 7, wherein a stop yoke is mounted on the sliding binding support in bores formed in the sliding binding support which receive the end legs thereof in a staggered manner.

9. Binding according to claim 1, which comprises a Cardan gear insert mounted between the hub and the binding support plate, said Cardan gear crank being formed by an inside toothing of a central circular opening and a toothed-wheel segment mounted on the hub body, the toothed-wheel segment being operatively connected to said at least one element wherein rotation of the binding support plate relative to the hub cases a longitudinal movement of said at least one element.

10. Binding according to claim 1, wherein the hub comprises a disk with a cover adjustably positioned thereon within an angular sector.

11. Binding according to claim 10, wherein the adjustment within the angular sector takes place via a screw (38) guided in a curved bearing hole (37).

12. Binding according to claim 1, wherein said at least one element comprises a traction and pressing rod.

13. Binding according to claim 1, which comprises a step layer secured to the hub, said stop lever projecting laterally therefrom, said stop lever being lockable in the running position with a notch of a stop member secured to the binding support plate.

14. Binding according to claim 1, which comprise damping elements located beneath in the hub, said damping elements comprises an elastomer to dampen oscillations and vibrations between the sports apparatus and the binding.

15. Binding according to claim 1, which comprises two binding bodies, each having two laterally opposed holding jaws, which cooperate with said at least one element positioned on the hub in such a way that, upon rotation of the binding support plate, the holding jaws move toward or away from each other so that a sole portion of a boot is fixed or released.

16. Binding according to claim 15, wherein the jaws are engageable with said holding means so that accurate fixing or releasing thereof is made possible.

17. Binding according to claim 1, wherein the binding bodies have stop yokes engageable therewith, and a closure lever is provided on one of the stop yokes to facilitate opening of the binding or closing thereof without rotary movement.

18. A binding for one of a snowboard, ski, monoski, and a snowshoe, which comprises:

a hub fixed thereof;

a binding support plate rotatingly disposed about said hub, the binding support plate being fixable in relation to the hub in the running position and bearing two bodies and having a holding device secured thereto for a boot; and at least one element receiving pulling and/or pushing forces which is connected to the hub, a first end of said at least one element engaging the hub and a second end thereof being coupled to said holding device such that upon rotation of the binding support plate, the holding device fixes the boot in the binding or releases the boot by the mutual spacing of the binding bodies being modified as a function of the position thereof relative to the hub through an operative connection via said at least one element being connected to the hub, one end thereof being formed so as to engage the hub in cooperation with said at least one element.

19. Binding according to claim 18, wherein the holding device comprises one pair each of sliding or swiveling holding jaws which are secured to the two bodies.

20. Binding according to claim 18, wherein the holding device comprises a pair of swiveling stop yokes which are respectively secured to the two bodies.

21. Binding according to claim 18, wherein at least one of said bodies is displaceable on the binding support plate.

22. Binding according to claims 19 or 20, wherein said at least one element is mounted eccentrically on the hub.

23. Binding according to one of claims 19 or 20, wherein said at least one element has an engaging device and a guide groove is formed in the hub, the engaging device engaging the guide groove in such a way that upon rotation of the binding support plate, said at least one element undergoes longitudinal movement relative to the rotary binding support plate, which movement is transmitted to the binding body connected thereto.

24. Binding according to claim 18, which comprises a Cardan gear crank mounted between the hub and the binding support plate, said Cardan gear crank being formed by an inside toothing portion of a central circular opening and a toothed-wheel segment mounted on the hub, the toothed-wheel segment being operatively connected to said at least one element, wherein rotation of the binding support plate relative to the hub causes a longitudinal movement of said at least one element.

25. Binding according to claim 18, wherein the hub comprises a disk with a cover adjustably positioned thereon within an angular sector.

26. Binding according to claim 25, wherein the adjustment within the angular sector takes place via a screw guided in a curved bearing hole.

27. Binding according to claim 18, wherein said at least one element comprises a traction and pressing rod.

28. Binding according to claim 21, wherein a stop yoke is mounted on the sliding binding support in bores formed in the sliding binding support which receive end legs thereof in a staggered manner.

29. Binding according to claim 20, which comprises bearing plates disposed on the binding bodies, said bearing plates having stop faces for limiting swivel movement of the stop yokes.

30. Binding according to claim 18, which comprises a stop lever secured to the hub, said stop lever projecting laterally therefrom, said stop lever being lockable in the running position with a notch member secured to the binding support plate.

31. Binding according to claim 18, which comprises damping elements located beneath the hub, which is arranged as a base plate, said damping elements comprising an elastomer to dampen oscillations and vibrations between the sports apparatus and the binding.

32. Binding according to claim 18, which comprises two binding bodies, each having two laterally opposed holding jaws, said bodies cooperating with element in such a way that, upon rotation of the binding support plate, the holding jaw is moved toward or away from each other so that a sole portion of a boot is fixed or released.

33. Binding according to claim 32, wherein the jaws are engageable with said holding device so that accurate fixing or releasing thereof is made possible.

34. Binding according to claim 18, wherein the binding bodies have stop yokes engageable therewith, and wherein a closure lever is provided on one of the stop yokes to facilitate opening of the binding or a closing thereof without rotary movement.

* * * * *